United States Patent [19]

Fujii

[11] Patent Number: 4,955,414

[45] Date of Patent: Sep. 11, 1990

[54] BEARING HAVING A VALVE SEAT FOR A ROTARY COMPRESSOR

[75] Inventor: Eiichiro Fujii, Fuji, Japan

[73] Assignee: Kabushiki Kaisha Toshiba, Kawasaki, Japan

[21] Appl. No.: 349,858

[22] Filed: May 10, 1989

[30] Foreign Application Priority Data

May 24, 1988 [JP] Japan ..... 63-126511

[51] Int. Cl.[5] ..... C22C 38/36

[52] U.S. Cl. ..... 148/324; 148/321; 148/906

[58] Field of Search ..... 148/906, 321, 324; 420/13

[56] References Cited

U.S. PATENT DOCUMENTS 4,435,226 3/1984 Neuhauser et al. ..... 148/324

4,467,510 8/1984 Kinoshita et al. ..... 420/13

FOREIGN PATENT DOCUMENTS 2044052 3/1971 Fed. Rep. of Germany ..... 148/321

47-4791 2/1972 Japan ..... 148/321

OTHER PUBLICATIONS

"Seimitsu Kikai (Precision Machinery), vol. 51, No. 5, 1985, 'Fe-Ni Alloy' by Shinichi Enomoto".

*Primary Examiner*—Deborah Yee

*Attorney, Agent, or Firm*—Cushman, Darby & Cushman

[57] ABSTRACT

A bearing having a valve seat for a rotary compressor which is made of austenitic cast iron with graphite crystallized in an austenite matrix in the form of an A type, C type or A/C combined type under the ISO classification, maximum length crystallized graphite being in a range of 0.45 to 1.4 mm.

2 Claims, 3 Drawing Sheets

BEARING HAVING A VALVE SEAT FOR A ROTARY COMPRESSOR

BACKGROUND OF THE INVENTION

1. Field of the Invention

The present invention relates to a bearing having a valve seat for a rotary compressor and, in particular, a rotary compressor bearing consisting of specific austenitic cast iron.

2. Description of the Related Art

For example, a vertical type rotary compressor has a cylinder with a main bearing fixed on an upper side and a sub-bearing fixed on a lower side thereof. An exhaust outlet extends through the main bearing in an up and down direction and a valve seat is formed at an upper surface of the main bearing which is situated near an opening of the exhaust outlet. An exhaust valve and valve stopper are located over the valve seat. A shaft is journaled in the main bearing and sub-bearing to rotate, for example, in a counter-clockwise direction and extends through the bearings and cylinder. An eccentric member is formed integral with a shaft portion defined within the cylinder such that it is biased. A rotor is mounted on the eccentric member. A suction inlet and blade groove are opened in the side wall of the cylinder. The blade is inserted in a horizontal direction through the blade groove and the upper and lower surfaces of the blade are in slide contact with the main bearing and sub-bearing. The blade is spring-urged in the horizontal direction such that a front surface of the blade is normally in slide contact with the rotor which is situated within the cylinder. By so doing, a spacing between the cylinder and the rotor is separated into a low pressure space and high pressure space.

In the operation of the aforementioned rotary compressor, the exhaust valve is moved up and down relative to the valve seat due to high and low pressure in a space between the cylinder and the rotor. For that reason, a noise corresponding to an inherent frequency of the main bearing is generated by an energy which is induced due to an impact of the exhaust valve upon the valve seat.

A bearing incorporated into the rotary compressor, and in particular, a main bearing having a valve seat is conventionally made of pearlitic cast iron with graphite crystallized in a pearlite matrix. Since, however, the main bearing made of pearlitic cast iron is low in specific damping capacity (SDC), it is not possible to effectively reduce noise which is generated due to an impact of the exhaust valve upon the valve seat upon the up and down movement of the exhaust valve.

Shinichi ENOMOTO "Iron-Nickel Alloy"(Low Expansion Alloy) was published, by a corporation (shadan-hojin) "Sheiki-Gakkai"(transliterated), as a separate volume regarding "austenitic cast iron"pp. 943 to 947, vol. 51, No. 5, May 5, 1985. This document discloses NOBINITE cast iron with graphite crystallized in great amount in an austenite matrix consisting of 2.45% of C, 1.94% of Si, 1.02% of Mn, 35.54% of Ni, 2.10% of Co and a balance of Fe, all of which are percent by weight. The NOBINITE cast iron has the properties of being high in damping capacity and better in castability and workability and can be applied to, for example, the bed, table and frame of machines, but never satisfies the wear resistance.

SUMMARY OF THE INVENTION

The object of the present invention is to provide a bearing having a valve seat for a rotary compressor which can largely reduce noise which is induced due to an impact of an exhaust valve upon a valve seat upon the up and down movement of the valve.

Another object of the present invention is to provide a bearing having a valve seat for a rotary compressor which has an excellent wear resistance to a rotating shaft for a prolonged period of time.

According to the present invention a bearing having a valve seat for a rotary compressor is provided which is made of austenitic cast iron with graphite crystallized in an austenite matrix in the form of an A type, C type or A/C combined type under the ISO Classification, the maximum length crystallized graphite being in a range 0.45 to 1.4 mm.

DETAILED DESCRIPTION OF THE INVENTION

A vertical type rotary compressor with a bearing having a valve seat of the present invention incorporated therein will be explained below with reference to FIGS. 1 and 2.

Figure 1:
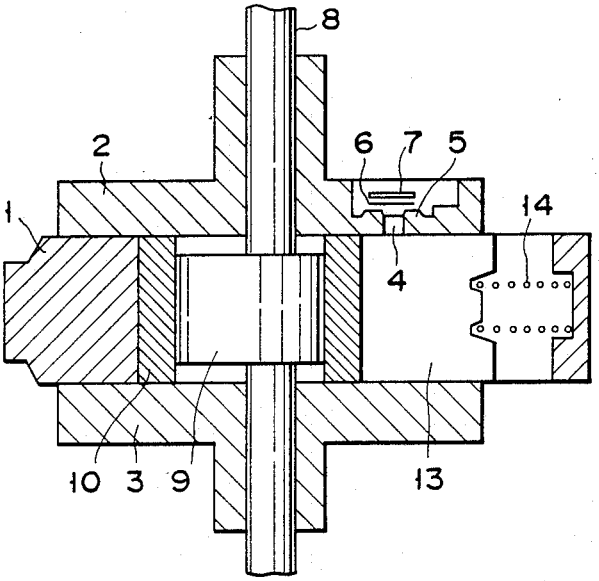
FIG. 1 is a cross-sectional view showing a vertical type rotary compressor with a bearing having a valve seat of the present invention incorporated therein.
Figure 2:
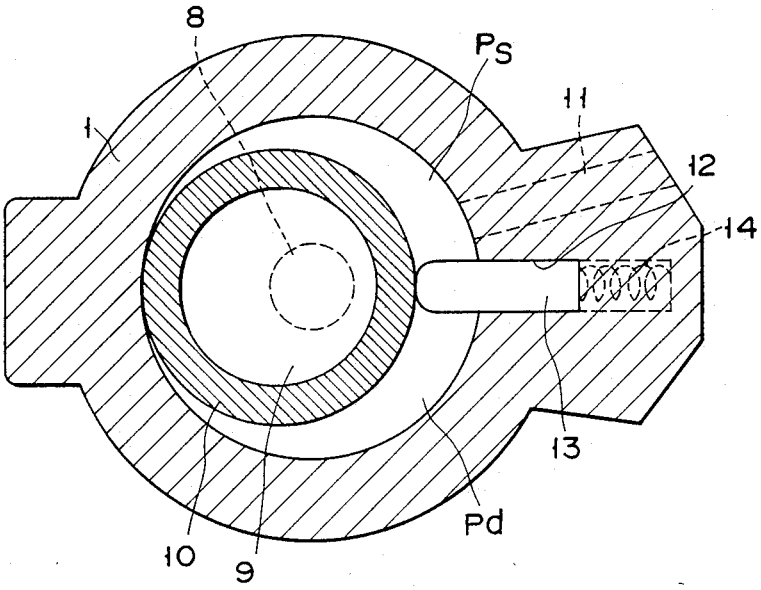
FIG. 2 is a cross-sectional view showing the rotary compressor of FIG. 1.

In FIGS. 1 and 2, a main bearing 2 and sub-bearing 3 are secured by a screw means, not shown, to a cylinder 1 such that the bearings 2 and 3 are located on the upper and lower sides, respectively. An exhaust outlet 4 vertically extends through the main bearing 2 and a valve seat 5 is formed near the opening of the exhaust outlet 4 which is formed in the upper portion of the main bearing 2. An exhaust valve 6 and valve stopper 7 are located over the valve seat 5. A shaft 8 is journaled in the main bearing 2 and sub-bearing 3 such that it extends through these bearings 2 and 3 and cylinder 1 and rotates in a clockwise direction. An eccentric member 9 is formed integral with that portion of the shaft 1, in a biased fashion, which is defined within the cylinder 1. A rotor 10 is mounted on the eccentric member 9. A suction inlet 11 and blade groove 12 are formed in the side wall of the cylinder 1. A blade 13 is inserted, in the horizontal direction, into the blade groove 12 with the upper and lower surfaces of the blade 13 in slide contact with the main bearing 2 and sub-bearing 3. The blade 13 is normally urged by a spring 14, in the horizontal direction, into slide contact with the rotor 10 within the cylinder 1 and hence separates an inner spacing of the cylinder 1 into a low pressure space Ps and high pressure space Pd.

The operation of the rotary compressor thus constructed will be explained below.

When the rotor 10 is rotated counterclockwise around the shaft 8 having the eccentric member 9 mounted thereon, air is sucked via the suction inlet 11 into the low pressure space between the cylinder 1 and the rotor 10 by the eccentric motion of the rotor 10. Upon further rotation of the rotor 10, the sucked air is compressed by the eccentric motion of the rotor 10 and, when that pressure reaches a predetermined pressure level, the exhaust valve 6 which is situated on the valve seat 5 of the main bearing 2 is opened, causing compressed air to be exhausted via the exhaust outlet.

The main bearing 2 having the valve seat 5 is made of austenitic cast iron as will be set forth below.

The austenitic cast iron is of such a type that graphite crystallizes out in an austenitic matrix. The austenite matrix consists essentially of 3.2 to 4.0% of C, 2.0 to 2.8% of Si, 4.0 to 6.0% Mn, 10.0 to 12.0% of Ni and a balance of Fe, all of which are percent by weight.

Figure 3A:
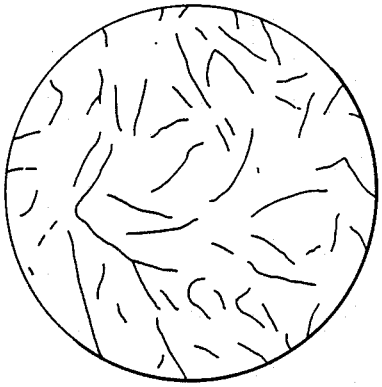
FIGS. 3A to 3E are an explanatory view showing, as models, an A type, B type, C type, D type and E type of crystallized graphite which are classified under the ISO Classification.
Figure 3B:
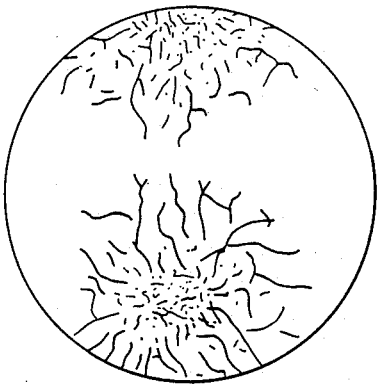
Figure 3C:
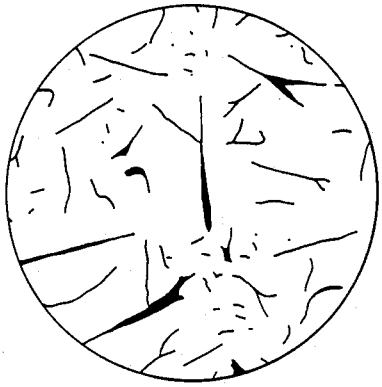
Figure 3D:
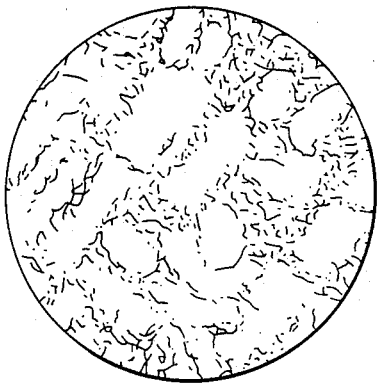
Figure 3E:
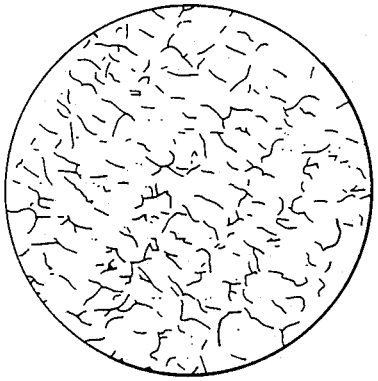

The graphite crystallizes out in the form of an A type, C type and A/C combined type under the ISO Classification. That is, according to the ISO Classification there are A to E types as shown in FIGS. 3A to 3E. FIG. 3A shows the A type; FIG. 3B, the B type; FIG. 3C, the C type; FIG. 3D, the D type; and FIG. 3E, the E type. The crystallized graphite in the austenitic matrix takes the forms: the A type as shown in FIG. 3A, the C type as shown in FIG. 3C or the A/C combined type all under the ISO Classification. In the forms of the B, D and E types as shown in FIGS. 3B, 3D and 3E, respectively, the crystallized graphite is fine in structure. Hence those bearings which are made of the austenitic cast iron with graphite crystallized in the austenite matrix in the aforementioned various forms cannot achieve an improved SDC.

It is preferable that the graphite be crystallized in a ratio of 10 to 50 vol% against the austenite matrix. The reason for this is as follows. For the ratio of the crystallized graphite less than 10 vol%, it is difficult to obtain an intended bearing due to a fall in the SDC of austenitic cast iron. For the ratio of the crystallized graphite exceeding 50 vol% it is difficult to obtain an intended object due to a fall in the mechanical strength of the austenitic cast iron. The crystallized graphite ratio is preferably 15 to 40 vol% and more preferably 20 to 30 vol%.

The crystallized graphite has a maximum length of 1.4 mm, with 15 to 30% by volume, of the crystallized graphite having a length of 0.45 to 1.4 mm. If too much of the crystallized graphite has a length of less than 0.45 mm, the wear resistance and SDC of the austenitic cast iron is reduced, making it difficult to obtain a desired bearing. On the other hand, if the length of the crystallized graphite exceeds the 1.4 mm limit, the mechanical strength of the austenitic cast iron is reduced, making it difficult to obtain a desired bearing.

The sub-bearing 3 is made of the aforementioned austenitic cast iron, a material the same as that of the main bearing 2. The sub-bearing 3 may be made of a normal pearitic cast iron with the graphite crystallized in the pearite matrix, since the valve seat is not provided there.

According to the present invention, a bearing having a valve seat for a rotary compressor is provided which is made of austenitic cast iron with graphite crystallized in an austenite cast iron in the form of an A type, C type or A/C combined type under the ISO Classification and with the maximum length crystallized graphite in a range 0.45 to 1.4 mm and has an adequate tensile strength and hardness as well as a higher SDC than that of a conventional pearlitic cast iron whereby it is possible to, upon the incorporation of the bearing into the rotary compressor, largely reduce the generation of noise due to an impact of an exhaust valve on a valve seat involved upon the up and down movement of the exhaust valve. It is also possible to provide a bearing having a valve seat for a rotary compressor which is excellent in wear resistance and hence durable for a prolonged period of time.

DESCRIPTION OF THE PREFERRED EMBODIMENTS

A preferred embodiment of the present invention will be explained below in more detail.

EXAMPLE 1-1, 1-2

Two kinds of test pieces 100 mm long, 10 mm width and 1 mm thick were manufactured from austenitic cast iron. The anstenitic cost iron had a composition, crystallization form (ISO Classification), amount, maximum length crystallized graphite, ratio of the maximum length crystallized graphite occupied in the crystallized graphite, tensile strength and hardness, all relating to graphite as shown in Table.

TABLE

| | austenite matrix (wt %) | | | | | | ISO Classification | amount of graphite crystallized (vol %) | max. length graphite crystallized (mm) | ratio (%) of max. length crystallized graphite in crystallized graphite | tensile strength (Kg/mm$^2$) | hardness HB |
|---|---|---|---|---|---|---|---|---|---|---|---|---|
| | C | Si | Mn | Ni | Co | Fe | | | | | | |
| Example 1-1 | 3.20 | 2.32 | 5.50 | 11.1 | — | bal | A + C | 20 | 0.45 | 18 | 12.5 | 84 |
| Example 1-2 | 3.20 | 2.32 | 5.50 | 11.1 | — | bal | A + C | 20 | 1.40 | 18 | 9.4 | 80 |
| Control 1-1 | 3.20 | 2.32 | 5.50 | 11.1 | — | bal | A + C | 20 | 0.05 | 18 | 16.0 | 120 |
| Control 1-2 | 3.20 | 2.32 | 5.50 | 11.1 | — | bal | A + C | 20 | 0.10 | 18 | 14.8 | 108 |
| Control 1-3 | 3.20 | 2.32 | 5.50 | 11.1 | — | bal | A + C | 20 | 0.20 | 18 | 14.9 | 100 |
| Control 2 | 3.03 | 1.50 | 0.54 | 0.06 | < 0.06 | bal | A | 15 | 0.18 | 100 | 20.0 | 160 |

Controls 1-1 to 1-3

Three kinds of test pieces 100 long, 10 mm width and 1 mm thick were manufactured from austenitic cast iron having a composition, crystallization form (ISO Classification), amount, maximum length crystallized graphite, ratio of maximum length crystallized graphite occupied in the crystallized graphite, tensile strength and hardness, all relating to graphite as shown in Table.

Control 2

A test piece 100 mm long, 10 mm wide and 1 mm thick was manufactured from a composition, crystallization form (ISO Classification), amount, maximum length graphite crystallized occupied in the crystallized graphite, tensile strength and hardness, all relating to graphite as shown in Table.

Figure 4:
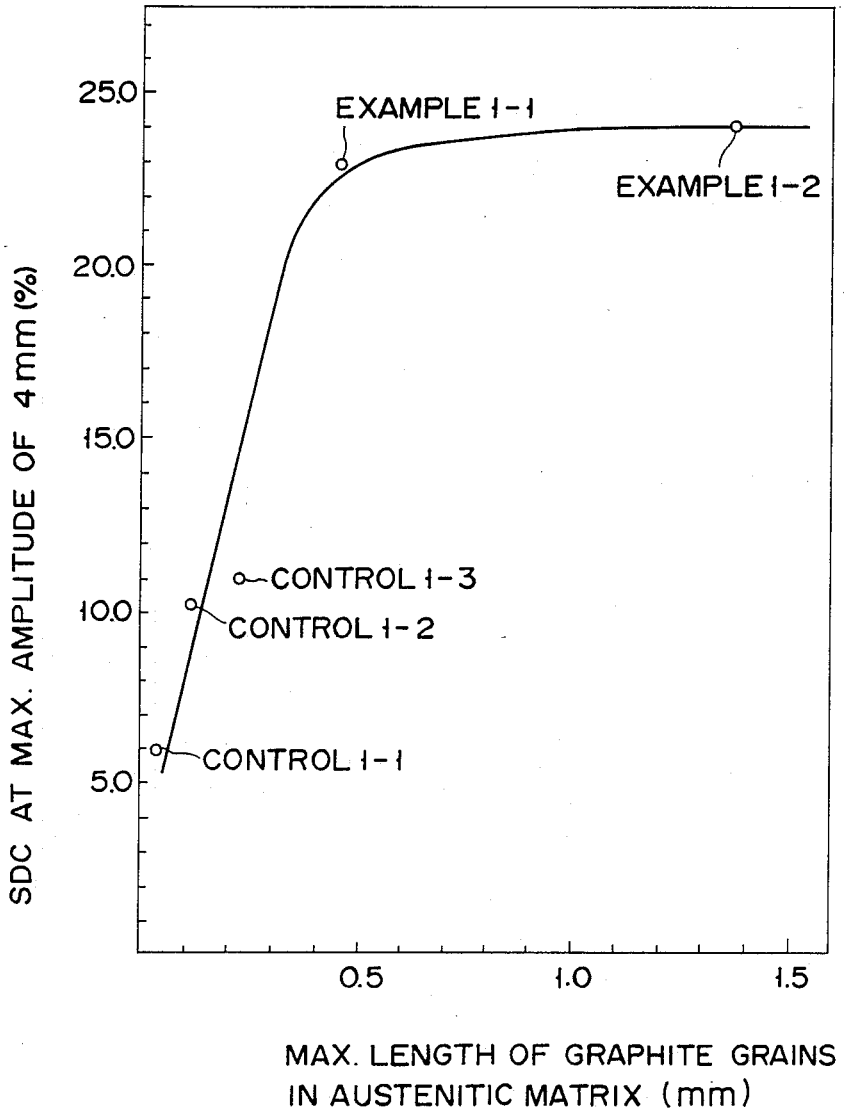
FIG. 4 is a characteristic curve showing a relation, to an SDC, of the maximum length graphite pieces crystallized in an austenite matrix of austenitic cast iron of which a bearing is made as Examples 1-1, 1-2 and Controls 1-1, 1-2, 1-3.

The test pieces of Examples 1-1, 1-2, and Controls 1-1 to 1-3 were measured by a light deflection meter under the conditions of a maximum amplitude of 4 mm, the results of which are as shown in FIG. 4.

For Controls 1-1 to 1-3 manufactured from austenitic cast iron with graphite crystallized in the austenitic matrix and with a maximum length crystallized graphite within a range less than 0.45 mm as shown in FIG. 4, the aforementioned SDC is an extremely low value as low as below 10%. For examples 1-1, 1-2 manufactured from the austenitic cast iron with graphite crystallized in the austenitic matrix and with the maximum length crystallized graphite within a range of 0.45 mm to 1.40 mm, on the other hand, the SDC reveals a very high value of over 22%. In this connection it is to be noted that, for the test piece of Control 2, the SDC was measured under the same conditions as set forth above to find that the SDC was as low as 5%.

Bearings having a valve seat were manufactured from austenitic cast iron of Examples 1-1, 1-2 and Control 2 as shown in Table. A rotary compressor was assembled, as shown in FIGS. 1 and 2, using the bearings and measured for the level of noise, noting that a shaft 14 mm in diameter was made of ductile cast iron and that a exhaust valve was made of carbon steel. For the bearing of Control 2, the noise was 62.6 dB under the conditions that the number of rotations of the shaft and inherent oscillation were 3600 rpm and 1.6 KHz, respectively. For the bearings of Examples 1-1 and 1-2, tests were performed under the same conditions and the noise was 57 dB, a level which is about 5 dB lower than that of Control 1-2. For Examples 1-1 and 1-2, it was possible to attain noise reduction by the extent of 2 dB.

The rotary compressors as shown in FIGS. 1 and 2 similarly were assembled using the bearings and withstand tests were preformed under the conditions of 3600 rpm as the number of rotations of the shaft and 1.6 KHz as the inherent oscillation. In Control 3, rotary compressors as shown in FIGS. 1 and 2 were assembled using a bearing manufactured from NOBINITE cast iron with graphite crystallized in great mount in an austenitic matrix consisting of 2.45% of C, 1.94% of Si, 1.02% of Mn, 35.54% of Ni, 2.10% of Co and a balance of Fe, all of which are percent by weight, and then withstand tests were performed under the aforementioned conditions. As a result, those bearings of Examples 1-1 and 1-2, and that of Control 2 revealed a better slide contact with the shaft supported and, even after being employed for 500 hr, no problem occurred from the mechanical point of view. The bearing of Control 3 is severely worn at a starting phase of rotation of the shaft, failing to employ the bearing.

As set forth above, according to the present invention, a bearing having a valve seat for a rotary compressor can be provided which can greatly reduce a noise level generated due to an impact of an exhaust valve upon a valve seat upon the up and down movement of the exhaust valve and manifests an excellent wear resistance relative to a support shaft for a prolonged period of time.

What is claimed is:

1. A bearing having a valve seat, for a rotary compressor which is made of austenitic cast iron with graphite crystallized in an austenite matrix in the form of an A type, C type, or A/C combined type under the ISO classification, the crystallized graphite having a maximum length of 1.4 mm, that portion having a length of 0.45 to 1.4 mm comprising 15 to 30% by volume of the crystallized graphite.

2. The bearing according to claim 1, wherein said austenite cast iron consists substantially of 3.2 to 4.0% of C, 2.0 to 2.8% of Si, 4.0 to 6.0% of Mn, 10.0 to 12.0% of Ni and a balance of Fe, all of which are percent by weight.

* * * * *